US006058872A

United States Patent [19]

Latorre

[11] Patent Number: 6,058,872

[45] Date of Patent: May 9, 2000

[54] HYBRID HULL FOR HIGH SPEED WATER TRANSPORT

[75] Inventor: Robert G. Latorre, Metairie, La.

[73] Assignee: Board of Supervisors of Louisiana State University and Agricultural and Mechanical College, Baton Rouge, La.

[21] Appl. No.: 09/177,328

[22] Filed: Oct. 22, 1998

[51] Int. Cl.[7] ..... B63B 1/16

[52] U.S. Cl. ..... 114/272; 114/274; 114/61.1

[58] Field of Search ..... 114/271, 274, 114/272, 283, 288, 292, 61.1

[56] References Cited

U.S. PATENT DOCUMENTS

| | | | |
|---|---|---|---|
| 4,606,291 | 8/1986 | Hoppe | 114/61 |
| 4,896,621 | 1/1990 | Coles | 114/274 |
| 4,926,773 | 5/1990 | Manor | 114/61 |
| 4,996,935 | 3/1991 | Takeuchi | 114/61 |
| 5,311,832 | 5/1994 | Payne | 114/274 |
| 5,355,827 | 10/1994 | Barbazash et al. | 114/274 |
| 5,522,333 | 6/1996 | Lang et al. | 114/274 |
| 5,592,895 | 1/1997 | Schmidt | 114/274 |
| 5,711,494 | 1/1998 | Saiz | 244/12.1 |

OTHER PUBLICATIONS

Aframeev, Y. et al., "Hydrofoils on Catamaran Planing Hulls," Motor Boat and Yachting, 70:40–49 (1978) (Russian), portions translated English and edited by D. Tselnik et al. (1984).

Calkins, D., "The Hybrid Hydrofoil Catamaran (HYCAT)," pp. 246–257 in Proc. vol. II, Workshop on Developments in Hull Form Design (Wageningen, Netherlands Oct. 22–24, 1985).

Doctors, L., "Analysis of the Efficiency of an Ekranocat: A Very–High Speed Catamaran with Aerodynamic Alleviation," pp. 1–21 in Proceedings of International Conference on Wing–In–Ground Craft (London, Dec. 4–5, 1997).

Gee, N., "The Catfoil—A Foil Assisted Catamaran for Fast Ferry and Yacht Applications," pp. 107–123 in Proceedings FAST '91 First International Conference on Fast Sea Transportation (Trondheim, Norway 1991).

Katz, J. et al., "Thin Airfoil in Ground Effect," pp. 187–191 in *Low Speed Aerodynamics* (1991).

Latorre, R. et al., "High Speed Vessels for Transport and Defense," International Symposium on High Speed Vessels for Transport and Defence, pp. 1–11 (Nov. 23–24, 1995, London).

Latorre, R. et al., "Development of High Speed Marine Vehicle Design Database," Gulf Coast Region Maritime Technology Center, pp. 1–32 (Feb. 1996).

Latorre, R., "Increasing Performance using Hybrid Catamaran Hull Designs," pp. 1–23, Proceedings of Innovations in Marine Technology International Workboat Show (Nov. 5–7, 1997).

Miyata, H., "Development of a New–Type Hydrofoil Catamaran," J. Ship Res., 33:135–144 (1989).

Zhao, I. et al., "A Study on Performance of Hydrofoil Type Planning Boats," Shipbuilding of China, Trans. Chinese Soc. Nav. Arch. Eng., 138:1–8 (1997) (Chinese, with English abstract).

*Primary Examiner*—Stephen Avila
*Attorney, Agent, or Firm*—John H. Runnels

[57] ABSTRACT

A catamaran-type boat having two or more demi-hulls that are connected by a wing-shaped superstructure is disclosed. The demi-hulls are further connected by two or more transverse hydrofoils. A tunnel is created between the demi-hulls and the superstructure. The shape of the superstructure takes advantage of the airflow through the tunnel to provide aerodynamic lift. The hydrofoils serve two purposes. The first is to provide hydrodynamic lift, and the second is to cancel wave build up between the hulls. The wave cancellation assists the stability of the craft by providing a relatively flat surface for the wing, to provide stable additional lift through the "wing in ground" effect. The combination of hydrodynamic lift, wave cancellation, and aerodynamic lift decreases the ship's drag and increases its speed.

9 Claims, 3 Drawing Sheets

HYBRID HULL FOR HIGH SPEED WATER TRANSPORT

The development of this invention was funded by the Government under contract no. 327-01-5114 awarded by the Navy through the Gulf Coast Region Maritime Technology Center. The Government has certain rights in this invention.

This invention pertains to boat hulls suitable for high speed water transport.

There is an unfilled need for economical, fast, high-capacity ferries and other ships to transport people and cargo distances of 100 to 1000 nautical miles. Airplanes have not been able to carry enough cargo at a reasonable cost. Ships can carry a high volume of cargo, but are too slow for many applications. A continuing problem is to design a vehicle that will carry a large volume of cargo at high speeds over these intermediate distances in a cost-efficient manner.

High-speed ferry craft today operate at 35–45 knots. At these speeds they are attractive for intercity shuttle service. However, speeds above 50 knots will be required to be attractive for longer 100–1000 nautical mile coastal operations. Simply scaling up today's high-speed ferry designs to handle 50 knot speeds and longer voyages would require substantial increases in engine size, larger fuel tanks, and in general would result in a bigger, more expensive ferry. Designs are needed for ferries that can operate at higher speeds with lower engine power and lower fuel consumption.

One way to increase a ship's speed is to decrease its drag, the resistance to travel through the water. Decreasing a ship's drag results in an increase in speed for the same engine output. A ship's drag is roughly proportional to the surface area of the hull, the "wetted surface" in the water. Catamaran hulls are usually more slender than an equivalent-sized mono-hull ship. At high speeds, this slenderness results in less total drag, even though the wetted surface (frictional drag) may be greater than that of an equivalent-sized mono-hull ship. A disadvantage of catamarans is that as the craft's speed increases, a wave forms between the hulls. This wave creates a hydraulic "jump," which dramatically increases drag, making higher speeds uneconomical. Drag increases because the jump between the hulls causes wave breakdown. For catamaran hulls with a relatively small hull-to-hull separation, this wave breakdown typically occurs around 45–50 knots. The obvious solution of widening the hull-to-hull spacing is impractical due to the cost and weight increases that would be needed for a larger catamaran cross-piece. No previous design has adequately accounted for the wave formed between catamaran hulls at high speed.

Another method to decrease a ship's drag is to use hydrofoils. Hydrofoils create lift that raises a ship partially or completely out of the water. Because material and size factors limit the hydrofoils' lift, it becomes difficult to design a large ship supported entirely by hydrofoils.

Fully hydrofoil-supported ships have other disadvantages. One such disadvantage is the need for automatic control of the foils to insure passenger comfort in rough seas. Furthermore, heavily-loaded hydrofoils tend to cavitate, which can cause erosion of hydrofoils when operated over long periods at speeds in the 40–50 knot range.

Another type of lifting system that has been used is a wing running near the ground, producing the so-called "wing-in-ground" effect. The "wing-in-ground" effect has been used in high-speed marine craft. While such wings have greater lift than do conventional wings due to the ground effect, there are operational problems when the wing passes over high sea waves. The craft must maintain a small (and fairly constant) wing-to-ground gap to maintain steady lift. Maintaining a constant gap is difficult for a craft moving across waves. In fact, the fluctuating lift resulting from the changing wing-to-ground distance can make a craft unstable.

There have been previous attempts to combine the aerodynamic lift of the "wing in ground" effect and the hydrodynamic lift of hydrofoils. The design of such craft has been based upon that of airplanes, designed to fly or glide through the air. Hydrodynamic lift in such a vehicle has been used primarily to get the craft started, and then to lift off the water and into ground-effect flight. The requirement that these craft be able to fly has limited their cargo-carrying capacity.

U.S. Pat. No. 4,606,291 discloses a high speed, small craft based upon a catamaran design. The craft has two asymmetrical hulls connected by a superstructure with a flat or concave bottom. The space between the parallel hulls and the superstructure creates a tunnel. A hydrofoil extends at least part way across the tunnel to provide lift.

U.S. Pat. No. 4,926,773 discloses a craft with a central body and two wings. Catamaran hulls are attached to the wing tips to provide floatation and to serve as fuel tanks. Hydrofoils are positioned on struts extending from the central body and from each catamaran. Lift is provided by the hydrofoils and the wings. The hydrofoil struts are adjustable, to maintain the vehicle over waves as the waves change the aerodynamic lift.

U.S. Pat. No. 5,711,494 discloses a craft with a catamaran hull that is designed to glide or fly above the ocean. Lift is provided by a several retractable fins that extend into the water from the hulls. A tilt rotor directing the engine thrust provides additional lift. A central tunnel between the hulls uses a planar surface to provide lift through the wing in ground effect.

U.S. Pat. No. 4,996,935 discloses a racing catamarans with hydrofoil qualities, having a pair of forward hulls with hydrofoils, as well as a pair of aft hulls with hydrofoils.

U.S. Pat. No. 5,311,832 discloses a hydrofoil craft in which shock struts allow the hydrofoils to move in concert with upgusts and downgusts of water velocity near the foil, to enable the foil to maintain approximately constant lift. The same principle was applied to aircraft of the wing in ground effect type, flying close to the water surface.

U.S. Pat. No. 4,896,621 discloses a hydrofoil craft characterized by an axial tunnel intermediate the bow and transom of a catamaran hull, with a dihedral foil beneath the water line on either side of the bow to obstruct and create turbulence in the forward end of the tunnel, while cushioning shock and lifting the bow; and simultaneously enclosing the transom end of the tunnel with a foil to compress the turbulence and lift the transom.

Y. Aframeev et al., "Hydrofoils on Catamaran Planing Hulls," Motor Boat and Yachting, 70:40–49 (1978) (Russian), portions translated into English and edited by D. Tselnik et al. (1984) discloses catamaran craft that use hydrofoils to eliminate wave formation between the hulls, to produce catamaran hulls having the same drag as monohull craft at moderate speeds.

H. Miyata, "Development of a New-Type Hydrofoil Catamaran," J. Ship Res., 33:135–144 (1989) discloses a catamaran with two sharp hulls, and two rectangular hydrofoils of high aspect ratio that connect them.

D. Calkins, "The Hybrid Hydrofoil Catamaran (HYCAT)," pp. 246–257 in Proc. Vol. 11, Workshop on Developments in Hull Form Design (Wageningen, Netherlands Oct. 22–24, 1985) discloses the combination of a planing catamaran hull with two submerged hydrofoils mounted in tandem fore and aft.

N. Gee, "The Catfoil—A Foil Assisted Catamaran for Fast Ferry and Yacht Applications," pp. 107–124 in Proceedings FAST '91 First International Conference on Fast Sea Transportation (Trondheim, Norway 1991) discloses a catamaran hull-hydrofoil combination said to be operable as a high speed ferry.

I. Zhao et al., "A Study on Performance of Hydrofoil Type Planing Boats," Shipbuilding of China, Trans. Chinese Soc. Nav. Arch. Mar. Eng., 138:1–8 (1997) (Chinese, with English abstract) discloses that well-designed channel hydrofoils can reduce planing resistance in planing boats by about 25%, can increase ship speed above 18%, and can provide extra load capacity of 15%.

J. Katz et al., "Thin Airfoil in Ground Effect," pp. 187–191 in *Low Speed Aerodynamics* (1991) describes the basic aerodynamics of the wing in ground effect.

L. Doctors, "Analysis of the Efficiency of an Ekranocat: A Very-High Speed Catamaran with Aerodynamic Alleviation," pp. 1–21 in Proceedings of International Conference on Wing-In-Ground Craft (London, Dec. 4–5, 1997) discusses the use of the wing in ground effect to provide aerodynamic lift to a catamaran, thereby reducing drag. Doctors' theoretical analysis (with no experimental data) made the unrealistic assumption that the water surface is horizontal and flat. In fact, at high speeds the water surface between the catamaran hulls does not remain flat and horizontal. At high speeds the rise in the water surface would cause the lift of the wing to become unsteady. Doctors provided no suggestion for how to overcome the inevitable effects of deformation of the water's surface at high speeds.

Reviews of prior catamaran technology appear in R. Latorre et al., "High Speed Vessels for Transport and Defense," International Symposium on High Speed Vessels for Transport and Defense (Nov. 23–24, 1995, London); and R. Latorre et al., "Development of High Speed Marine Vehicle Design Database," Gulf Coast Region Maritime Technology Center (February 1996).

I have discovered a novel hull design, combining features of a catamaran, hydrofoils, and a wing. The novel hull design is suitable for use in a high-speed marine craft that can carry substantial loads. It is capable of efficient operation at 50 knots and higher. The novel design, which I call the "Lift Cat," has two or more catamaran hulls, which are the primary cargo-carrying locations of the ship. The catamaran hulls may also be used for fuel storage. The hulls are located so as to create a parallel channel between them. The center cross section connecting the catamaran hulls is shaped as an airfoil or wing to create aerodynamic lift. The wing-shaped cross piece is arranged over the channel(s) to be as close to the water as feasible, to take maximum advantage of the "wing-in-ground" effect to partially lift the hull, thereby reducing drag. The catamaran hulls are also connected to one another by two or more transverse submerged hydrofoils, which extend across the channel created by the hulls. The hydrofoils not only provide lift to the ship, but are also positioned to cancel the rise in the water surfaces and wave buildup between the catamaran hulls, especially in the stern area where a breaking wave can otherwise form.

The hydrofoils cancel the wave rise and wave breaking otherwise produced by catamarans at high speed. Elimination of the wave breaking allows the "wing-in-ground" effect to be safely realized at high speeds. The water surface under the wing is now flat, or at least is consistent. Thus drag due to a hydraulic jump or to wave breaking is eliminated or greatly reduced, and speed can be significantly increased. The ratio of the aft foil upper surface submergence below the calm water surface, h, to foil chord c (the aft hydrofoil nose-to-tail length) should be in the range $0.05<h/c<0.75$. In this range of submergence, the aft foil can be positioned within 5 chord lengths (5*c*) ahead of the catamaran stern. In this submerged and offset position, the hydrofoils are able to produce a trailing wave whose trough cancels the hydraulic jump wave by superposition.

Maintaining an approximately constant distance between the wing and the water means that lift from the wing-in-ground effect will remain fairly constant, even as the craft operates in rough seas. The foil system and the wing system can counteract vertical motions (heave) and pitching motions at high speed in waves. Thus the novel design can be safely used at higher speeds and in rougher water than has been the case for prior designs. The Lift-cat is self-regulating. As the ship rises from the water, the lift created from the wing in ground effect decreases, causing the ship to lower toward the water. As the ship lowers, the lift from the wing increases. Thus the craft is stabilized as it moves through the water.

As the speed of the ship increases, water near the hydrofoils can begin to cavitate. The cavitation decreases the lift from the foils, lowering the ship in the water. As the ship lowers, the lift caused by the wing in ground effect increases as the wing moves closer to the surface of the water.

The novel design can cary heavy loads, because the load is primarily born by the larger catamaran hulls, rather than by hydrofoil struts. The Lift Cat can operate at high speeds, 50, 70, 90 knots, or more, with relatively smaller engines and fuel tanks than in previous craft, resulting in a larger payload and more economical ferry.

BRIEF DESCRIPTION OF THE DRAWINGS

(FIGS. 3*a*–3*e* are adapted from Y. Aframeev et al. (1978).)

FIGS. 1*a* and 1*b* illustrate inboard (between the hulls) and outboard (outside the hulls) views, respectively, of an embodiment of the Lift-Cat. The catamaran demi-hulls 1 rest in the water. The wing-shaped cross piece or superstructure 3 is attached to the demi-hulls 1 above the water line 4. The demi-hulls are also connected to one another by transverse hydrofoils 2 below the water line 4. The hydrofoils 2 remain in the water while the vessel is in use.

FIG. 2 illustrates a midsection view of an embodiment of the Lift-Cat (cutting the ship in two and looking astern). The two demi-hulls 1 are connected by the cross piece 3 and by the hydrofoils 2. The combination of the cross piece 3, the demi-hulls 1, and the water line 4 creates tunnel 5. As the ship moves through the water, air flows through tunnel 5, and lift is created by the cross piece 3. This lift is amplified by the proximity of the cross piece 3 to the water line 4 through the wing in ground effect.

In operation, the catamaran hulls are lifted partially out of the water by the aerodynamic lift from the wing-shaped center cross piece, and by hydrodynamic lift from the hydrofoils. Vessel drag at high speeds is thereby greatly reduced. The hydrofoils also cancel the rise in the water level between the catamaran hulls, further reducing drag. The water level between the hulls can thus be maintained nearly constant at high speeds, resulting in uniform lift from the wing in ground effect.

Figure 1:
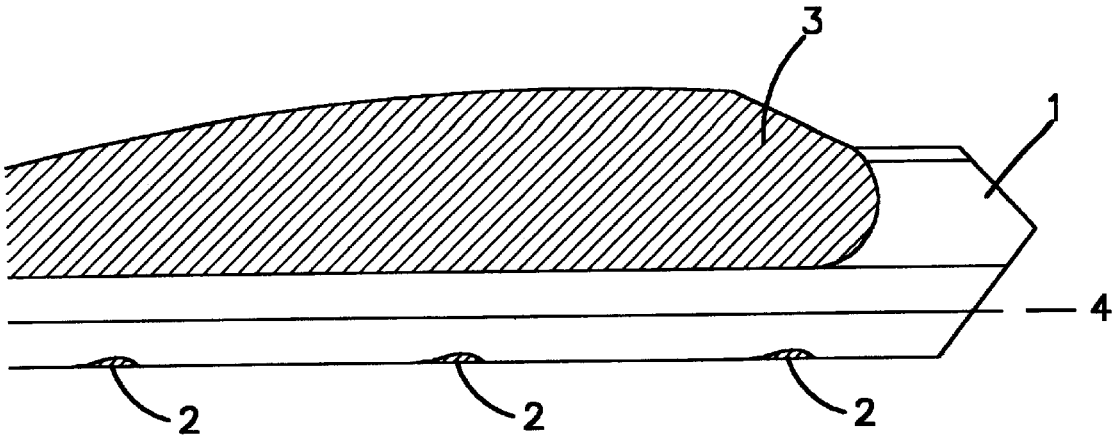
FIG. 1*a* illustrates an inboard profile of an embodiment of the Lift-Cat at rest.
FIG. 1*b* illustrates an outboard profile of an embodiment of the Lift-Cat at rest.
Figure 1:
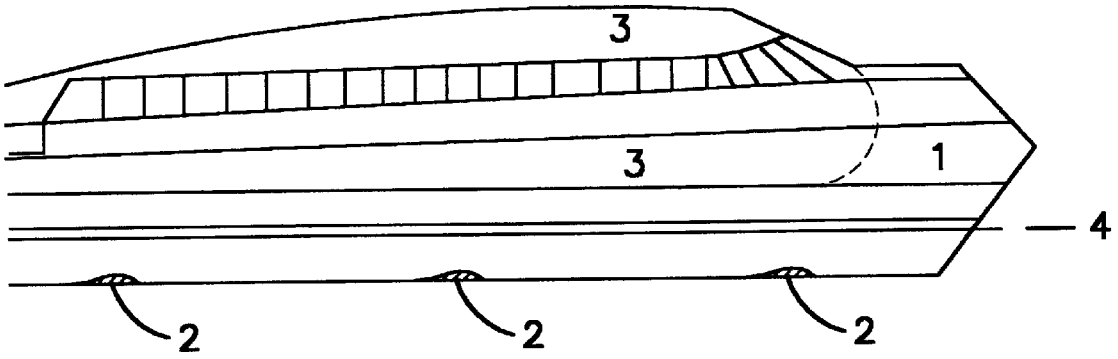
Figure 2:
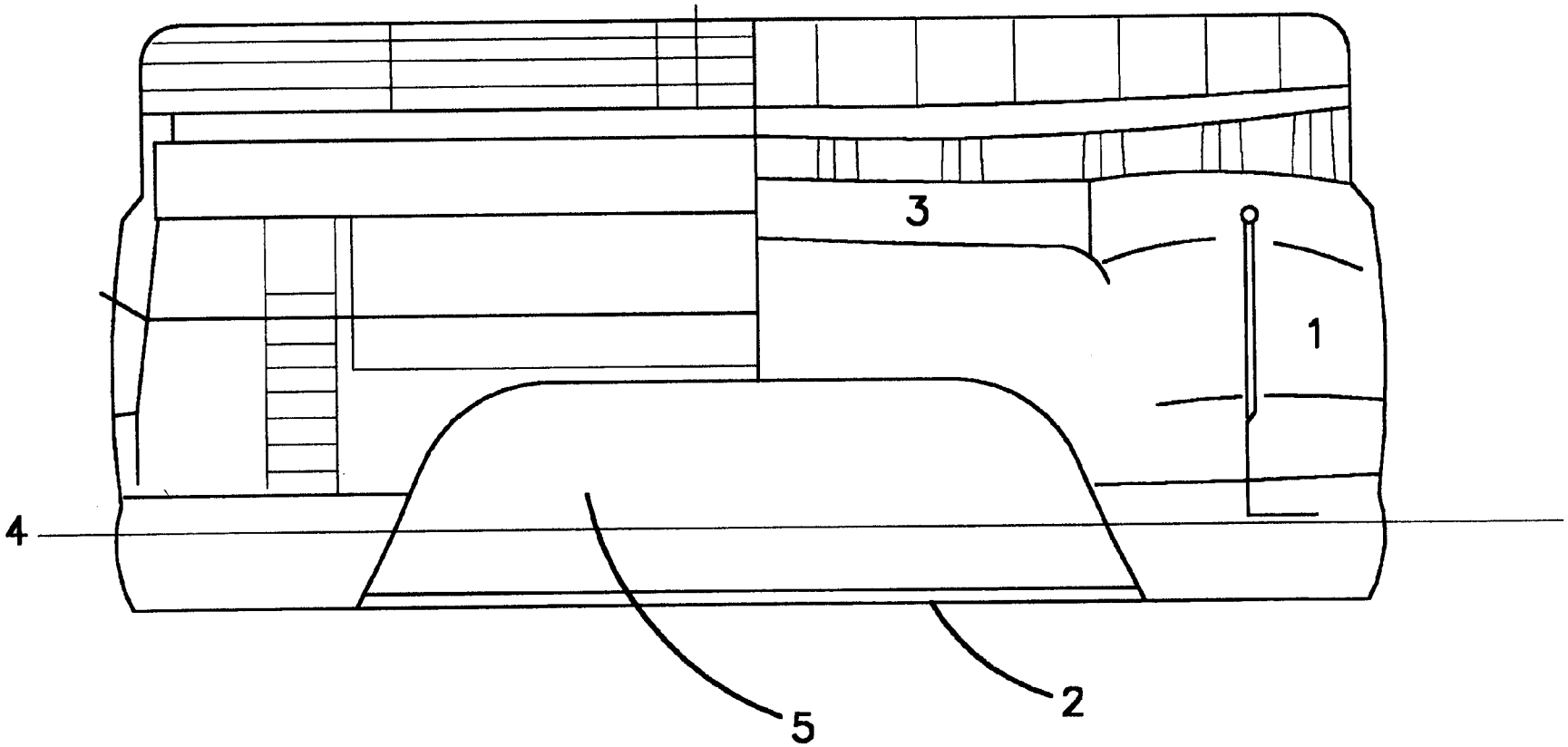
FIG. 2 illustrates a mid section view of an embodiment of the Lift-Cat.
Figure 3A:
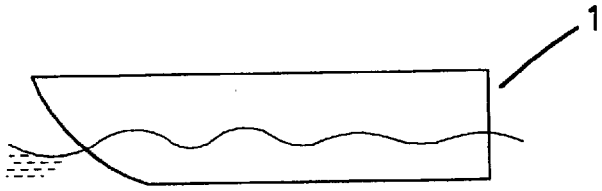
FIG. 3*a* illustrates schematically the profile of the water surface between the hulls of a catamaran without hydrofoils at a speed of 20–30 knots.
Figure 3B:
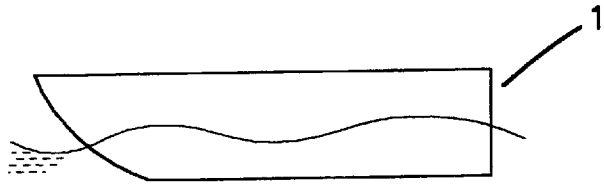
FIG. 3*b* illustrates schematically the profile of the water surface between the hulls of a catamaran without hydrofoils at a speed of 30–40 knots (current state of the art).
Figure 3C:
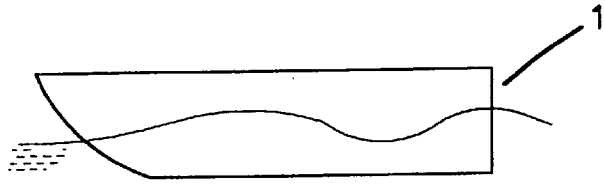
FIG. 3*c* illustrates a profile of the water surface between the hulls of a catamaran without hydrofoils at a speed of 40–50 knots.

Without cancellation from the hydrofoils, the catamaran would reach a speed at which the water build-up between the hulls would become significant. The water build-up would form a hydraulic jump, causing a large increase in drag as the catamaran's speed increases. This effect is illustrated schematically in FIGS. 3*a–d* for a 30-m long catamaran. FIG. 3*a* illustrates the water between the hulls at a speed of 20–30 knots. At 30–40 knots (FIG. 3*b*) the water surface begins to rise, an effect that grows at 40–50 knots (FIG. 3*c*). As the speed approaches 50 knots (FIG. 3*d*), a large wave typically forms, and the wave breaks as the speed increases further. Note the formation of a hydraulic jump at the stern. The wave-breaking significantly increases drag.

Figure 3D:
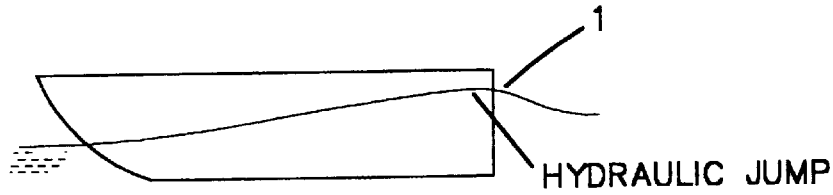
FIG. 3*d* illustrates a profile of the water surface between the hulls of a catamaran without hydrofoils at speeds greater than 50 knots.
Figure 3E:
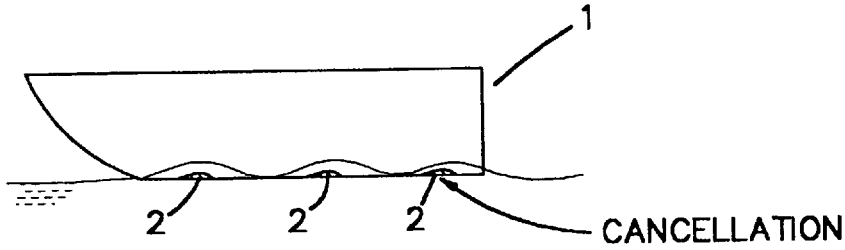
FIG. 3*e* illustrates a profile of the water surface between the hulls of a catamaran with three hydrofoils at high speed.

FIG. 3*e* shows the water between the hulls under the same conditions as in FIG. 3*d*, except that hydrofoils have cancelled the wave, and the water surface remains nearly flat.

The airfoil lift coefficient from the wing in ground effect is inversely proportional to the square of the height of the airfoil above the surface. This inverse square relation means both that there can be substantial aerodynamic lift from an airfoil near the surface of the water, and also that the aerodynamic lift could fluctuate substantially from changes in that height if there were no way to flatten the water surface between the hulls. The novel design allows controllable aerodynamic lift from the wing in ground effect, without substantial variation in that lift, because the placement of the hydrofoils keeps the water surface between the catamaran hulls nearly flat, and nearly constant. The mutual interaction of the airfoil and the hydrofoils allows the Lift-Cat to operate in a stable mode at speeds above 50 knots.

The aerodynamic lift provided by the wing in ground effect should be at least about 30% of the total weight of the boat, preferably about 50% of the total weight.

It is preferred that the total load be balanced by dividing it 50%±10% to the foils, and 50%±10% to the catamaran hulls.

The complete disclosures of all references cited in this specification are hereby incorporated by reference; as is the entire disclosure of the following paper, which is not prior art to the present invention: R. Latorre, "Increasing Performance using Hybrid Catamaran Hull Designs," pp. 1–22, Proceedings of Innovations in Marine Technology International Workboat Show (Nov. 5–7, 1997). In the event of an otherwise irreconcilable conflict, however, the present specification shall control.

I claim:

1. A boat capable of sustained, stable travel through water at speeds greater than 50 knots, said boat comprising:

(a) a plurality of substantially parallel catamaran hulls, wherein the space between two adjacent said hulls forms a channel on the surface of the water;

(b) a superstructure connected to and supported by said hulls, wherein forward motion of said boat produces aerodynamic lift on said superstructure through the wing in ground effect, the aerodynamic lift being at least about thirty percent of the weight of said boat; and (c) a plurality of hydrofoils substantially perpendicular to and underneath said hulls, connecting said hulls to one another; wherein forward motion of said boat produces hydrodynamic lift on said hydrofoils; and wherein said hydrofoils substantially damp out any wave that would be produced in each channel by said hulls in the absence of said hydrofoils; whereby the height of the surface of the water in each channel is substantially constant; whereby the substantially constant height of the water in each channel results in stable aerodynamic lift on said superstructure through the wing in ground effect; and whereby the height of said boat above the water at a particular speed is self-stabilizing, in that a lowering of said boat increases the aerodynamic lift on said superstructure through the wing in ground effect, and a raising of said boat decreases the aerodynamic lift on said superstructure through the wing in ground effect.

2. A boat as recited in claim 1, wherein forward motion of said boat produces aerodynamic lift at least about fifty percent of the weight of said boat.

3. A boat as recited in claim 1, comprising two of said catamaran hulls.

4. A boat as recited in claim 1, comprising more than two of said catamaran hulls.

5. A boat as recited in claim 1, comprising two of said hydrofoils.

6. A boat as recited in claim 1, wherein the ratio h/c of the submergence of the upper surface of the aft said hydrofoil below the calm water surface, h, to the aft said hydrofoil's nose-to-tail length, c, is between about 0.05 and about 0.75.

7. A boat as recited in claim 6, wherein the aft said hydrofoil is within a distance of about 5c ahead of the stern of said catamarans.

8. A boat as recited in claim 1, wherein said boat is capable of sustained, stable travel through water at speeds of at least 70 knots.

9. A boat as recited in claim 1, wherein said boat is capable of sustained, stable travel through water at speeds of at least 90 knots.

* * * * *